US011269369B2

(12) United States Patent
Dil et al.

(10) Patent No.: US 11,269,369 B2
(45) Date of Patent: Mar. 8, 2022

(54) OPERATING ELEMENT FOR A LABORATORY DEVICE

(71) Applicant: Hans Heidolph GMBH, Kelheim (DE)

(72) Inventors: Roman Dil, Nuremberg (DE); Giorgio Accardi, Abenberg (DE)

(73) Assignee: Hans Heidolph GMBH, Kelheim (DE)

( * ) Notice: Subject to any disclaimer, the term of this patent is extended or adjusted under 35 U.S.C. 154(b) by 3 days.

(21) Appl. No.: 16/486,230

(22) PCT Filed: Feb. 15, 2018

(86) PCT No.: PCT/EP2018/053828
§ 371 (c)(1),
(2) Date: Aug. 15, 2019

(87) PCT Pub. No.: WO2018/149936
PCT Pub. Date: Aug. 23, 2018

(65) Prior Publication Data

US 2020/0241586 A1 Jul. 30, 2020

(30) Foreign Application Priority Data

Feb. 20, 2017 (DE) ..... 20-2017100925.4

(51) Int. Cl.
*G05G 1/10* (2006.01)
*B01F 15/00* (2006.01)
(Continued)

(52) U.S. Cl.
CPC ..... *G05G 1/10* (2013.01); *B01F 15/00123* (2013.01); *B01L 9/00* (2013.01);
(Continued)

(58) Field of Classification Search
CPC ..... G05G 1/02; G05G 1/025; G05G 1/08; G05G 1/10; G05G 1/105; G05G 1/12;
(Continued)

(56) References Cited

U.S. PATENT DOCUMENTS 2,190,577 A * 2/1940 Tinnerman ..... G05G 1/12 403/357
3,494,207 A 2/1970 Clements
(Continued)

FOREIGN PATENT DOCUMENTS

CN 2854672 Y 1/2007
CN 200944200 Y 9/2007
(Continued)

OTHER PUBLICATIONS

Machine Translation of EP 1615250, obtained Feb. 5, 2021.*
CNIPA search report for CN201880026231, dated Apr. 26, 2020, p. 7/8.

*Primary Examiner* — Richard W Ridley
*Assistant Examiner* — Brian J McGovern
(74) *Attorney, Agent, or Firm* — Wiggin & Dana LLP; Gregory S. Rosenblatt; Rikesh P. Patel

(57) ABSTRACT

The invention relates to an operating element (11) having a support part (13) which can be mounted on a device housing, in particular on a housing of a laboratory device, for example a laboratory stirrer, and having a rotary knob (15) which is held on the support part, is rotatable about an axis of rotation, is provided with a permanent magnet (17) and is additionally adjustable relative to the support part in the axial direction between a released position and a depressed position, wherein, as a result of a magnetic force acting between the support part and the rotary knob, the rotary knob can be reset from the depressed position into the released position.

15 Claims, 3 Drawing Sheets

Figure 1:
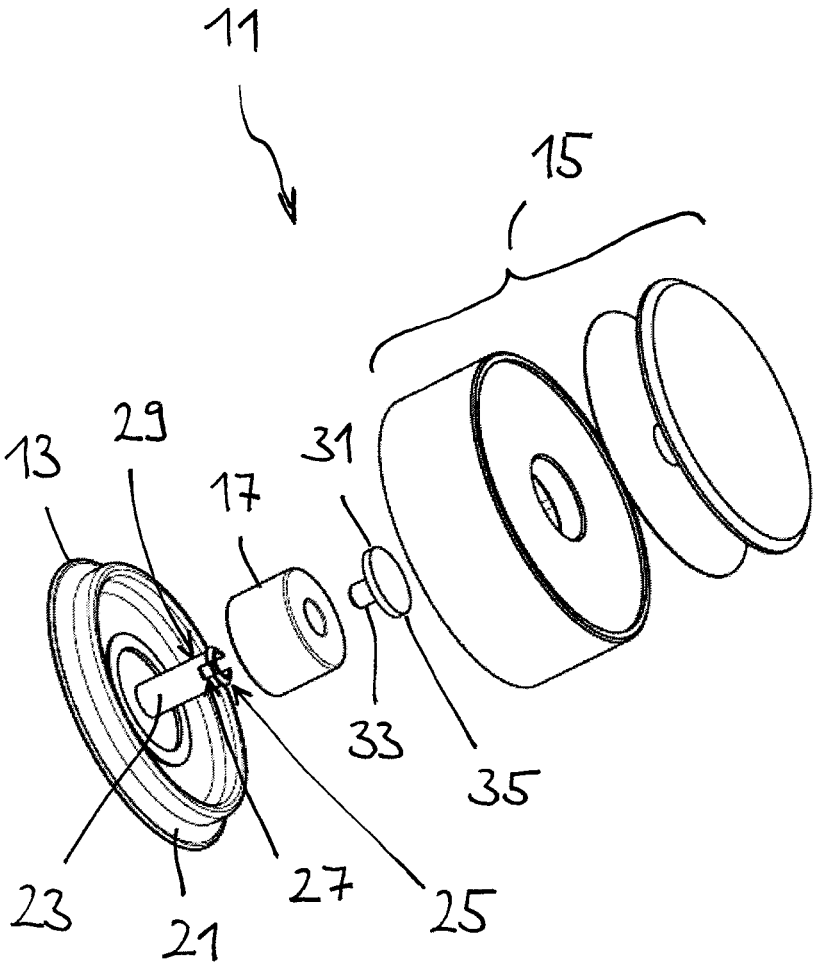

(51) Int. Cl.

| | |
|---|---|
| ***B01L 9/00*** | (2006.01) |
| ***G05G 5/05*** | (2006.01) |
| ***H01H 3/08*** | (2006.01) |
| ***H01H 3/50*** | (2006.01) |
| *G05G 1/02* | (2006.01) |
| *G05G 1/08* | (2006.01) |

(52) U.S. Cl.
CPC ..... *G05G 5/05* (2013.01); *H01H 3/08* (2013.01); *H01H 3/50* (2013.01); *B01F 2215/0037* (2013.01); *B01L 2200/025* (2013.01); *G05G 1/02* (2013.01); *G05G 1/08* (2013.01); *G05G 2505/00* (2013.01); *H01H 2003/506* (2013.01)

(58) Field of Classification Search
CPC .. G05G 5/05; H01H 3/02; H01H 3/08; H01H 3/12; H01H 3/50; H01H 2003/506; H01H 19/14; H01H 25/06; H01H 9/181
See application file for complete search history.

(56) References Cited

U.S. PATENT DOCUMENTS

| | | | | |
|---|---|---|---|---|
| 3,504,559 | A | 4/1970 | Shaw et al. | |
| 5,898,117 | A | 4/1999 | Ishida | |
| 5,988,587 | A | 11/1999 | Duchon et al. | |
| 6,179,829 | B1 | 1/2001 | Bisch et al. | |
| 6,288,351 | B1 * | 9/2001 | Bruntz ..... | H01H 3/10 200/11 R |
| 6,380,733 | B1 | 1/2002 | Apel et al. | |
| 6,781,569 | B1 | 8/2004 | Gregorio et al. | |
| 2007/0040802 | A1 | 2/2007 | Dider et al. | |
| 2007/0040803 | A1 | 2/2007 | Dider et al. | |
| 2008/0068117 | A1 | 3/2008 | Boss | |
| 2008/0236018 | A1 | 10/2008 | Halverson | |
| 2009/0183596 | A1 | 1/2009 | Tanner et al. | |
| 2009/0046054 | A1 | 2/2009 | Olien | |
| 2009/0212766 | A1 | 8/2009 | Olsen et al. | |
| 2010/0084249 | A1 | 4/2010 | Bandy et al. | |
| 2010/0265176 | A1 * | 10/2010 | Olsson ..... | G05G 9/047 345/161 |
| 2012/0025809 | A1 | 2/2012 | Banerjee et al. | |
| 2014/0033853 | A1 | 2/2014 | Kitahara et al. | |
| 2015/0029101 | A1 | 1/2015 | Shin | |
| 2015/0287557 | A1 * | 10/2015 | Fukunaga ..... | H01C 10/46 200/283 |
| 2017/0322585 | A1 | 11/2017 | Tomita et al. | |
| 2018/0090289 | A1 | 3/2018 | Wakuda et al. | |

FOREIGN PATENT DOCUMENTS

| | | | | |
|---|---|---|---|---|
| CN | 101046699 | A | 10/2007 | |
| CN | 204685102 | U | 10/2015 | |
| CN | 105091736 | A | 11/2015 | |
| CN | 204925864 | U | 12/2015 | |
| CN | 205109527 | U | 3/2016 | |
| CN | 105388961 | A | 9/2016 | |
| CN | 106292833 | A | 1/2017 | |
| CN | 106292834 | A | 1/2017 | |
| CN | 106325355 | A | 1/2017 | |
| DE | 7923060 | U1 | 1/1980 | |
| DE | 9111766 | U1 | 2/1992 | |
| DE | 19651315 | A1 | 6/1998 | |
| DE | 20019995 | U1 | 3/2001 | |
| DE | 10353181 | B3 | 2/2005 | |
| DE | 102006023534 | A1 | 11/2007 | |
| DE | 102006045735 | A1 | 3/2008 | |
| DE | 102007050435 | A1 | 4/2008 | |
| DE | 102008031685 | A1 | 1/2010 | |
| DE | 102010042586 | A1 | 5/2011 | |
| DE | 102010044146 | A1 | 5/2012 | |
| DE | 102010044148 | A1 | 5/2012 | |
| DE | 102013008033 | A1 | 11/2014 | |
| DE | 102014003637 | A1 | 9/2015 | |
| DE | 102014111712 | A1 | 2/2016 | |
| DE | 102014111715 | A1 | 2/2016 | |
| EP | 1615250 | A1 * | 1/2006 | ..... G05G 9/047 |
| EP | 2499547 | B1 | 1/2016 | |
| FR | 2935497 | A3 | 3/2010 | |
| JP | 55159214 | A | 12/1980 | |
| JP | 56060922 | A | 5/1981 | |
| JP | 61079939 | A | 4/1986 | |
| JP | 8161071 | A | 6/1996 | |
| JP | 9128082 | A | 5/1997 | |
| JP | 11153186 | A | 6/1999 | |
| JP | 3049072 | B2 | 6/2000 | |
| JP | 2001134335 | A | 5/2001 | |
| JP | 2006153975 | A | 6/2006 | |
| JP | 2007257281 | A | 10/2007 | |
| JP | 2007298063 | A | 11/2007 | |
| JP | 2010165281 | A | 7/2010 | |
| JP | 2010167999 | A | 9/2010 | |
| JP | 2011163783 | A | 8/2011 | |
| JP | 2012096706 | A | 5/2012 | |
| JP | 2012096710 | A | 5/2012 | |
| JP | 2012099043 | A | 5/2012 | |
| JP | 2014026616 | A | 2/2014 | |
| JP | 2014172420 | A | 9/2014 | |
| JP | 2015008593 | A | 1/2015 | |
| JP | 2015014830 | A | 1/2015 | |
| JP | 2015052903 | A | 3/2015 | |
| JP | 2012099037 | A | 5/2015 | |
| JP | 2016071627 | A | 5/2016 | |
| JP | 2016024763 | A | 7/2016 | |
| JP | 2016170886 | A | 9/2016 | |
| KR | 101380376 | B1 | 4/2014 | |
| WO | 2008012177 | A1 | 1/2008 | |
| WO | 12080156 | A1 | 6/2012 | |

* cited by examiner

OPERATING ELEMENT FOR A LABORATORY DEVICE

The present invention relates to a control element attachable to a device housing, and in particular to a housing of a laboratory device. The laboratory device can in particular be a laboratory stirrer such as an overhead stirrer or also a rotary evaporator, a magnetic stirrer, a shaking and mixing device, or a peristaltic pump.

A control element for a laboratory device is known from the document DE 10 2014 111 715 A1 that comprises a manually actuable rotary knob that is rotatable about an axis of rotation and into which a push button element provided with a permanent magnet is integrated that is adjustable between a non-pressed position and a pressed position, with a mechanical spring providing the return of the push button element. A sensor arrangement is provided within the housing of the laboratory device by which the rotary position of the rotary knob, on the one hand, and the axial position of the push button element, on the other hand, can be detected via the location of the permanent magnet. An operating parameter of the laboratory device can, for example, be set by the rotary knob and the setting of the operating parameter can then be confirmed by the push button element. The setup of this control element is, however, comparatively complex.

It is the underlying object of the in invention to simplify the design of a control element of the initially named kind.

This object is satisfied by a control element having the features of claim 1, and in particular by a control element having a carrier part attachable to a device housing, in particular to a housing of a laboratory device, for example of a laboratory stirrer, and having a rotary knob that is held at the carrier part, in particular releasably held, that is manually actuable, that is rotatable about an axis of rotation, that is provided with a permanent magnet, and that is additionally adjustable, in particular as a whole, in an axial direction relative to the carrier part between a non-pressed position and a pressed position, wherein the rotary knob can be returned from the pressed position into the non-pressed position on the basis of a magnetic force acting between the carrier part and the rotary knob.

No separate push button element is thus provided in accordance with the invention, but the rotary knob itself is pressed, in particular as a whole, to ensure the pressing operation. The rotary knob is in particular formed as a single-part rotary knob and push button. The return furthermore does not take place by a mechanical spring on a pressing actuation, but rather by a magnetic force acting between the carrier part and the rotary knob. No spring is thus required for the return. The rotary knob can in particular be returned without or free of a spring or the control element has a springless or spring-free structure. The structure of the control element in accordance with the invention is therefore particularly simple.

The rotational position and the axial position of the rotary knob can be recognized with reference to the axial position of the permanent magnet by a corresponding sensor arrangement, in particular by magnetic field sensors that are based on the Hall effect.

In accordance with a preferred embodiment of the invention, the rotary knob is fixedly connected to the permanent magnet and the carrier part is provided with an element composed of a magnetic material, in particular of a soft magnetic material, and is attracted by the permanent magnet to generate the magnetic force acting between the carrier part and the rotary knob. The magnetic, in particular soft magnetic, material is in particular a ferromagnetic, in particular soft magnetic, material. A magnetic material can be magnetized by the magnetic field of the permanent magnet and can then be attracted by the permanent magnet.

To establish the fixed connection, the rotary knob can have a receiver on its side facing the carrier part or at its inner side and the permanent magnet is received in it, in particular with an interference fit, in a force-fitted manner and in particular releasably. The permanent magnet is preferably, in particular only, insertable into the receiver from an axial direction and/or the receiver is, in particular only, placeable onto the permanent magnet from the axial direction. A fixed connection between the rotary knob and the permanent magnet can hereby be established in a particularly simple manner.

The permanent magnet and the magnetic element are in particular arranged with respect to one another such that the spacing between the permanent magnet and the magnetic element increases on the adjustment of the rotary knob into the pressed position. The pressed rotary knob can then be returned into the non-pressed position again by the attractive magnetic force acting between the permanent magnet and the magnetic element.

The magnetic material is preferably a ferritic steel. This material has shown itself to be particularly suitable for the present invention.

The permanent magnet is preferably configured as a ring magnet, in particular as a diametrically magnetized ring magnet. The carrier part can then have a carrier base that is attachable to a device housing and that is in particular disk-shaped, and can have a holding pin that projects from the carrier base in the direction of the rotary knob and onto which the ring magnet is placed, in particular in a latching manner. The rotary knob can hereby be positioned in the correct location at the carrier part in a simple manner and can in particular be held in the correct location at the carrier part. The free end of the holding pin, i.e. at least the free end of the holding pin, i.e. only the free end or also additionally the other end, and thus the total holding pin, can be formed in sleeve shape.

In accordance with a preferred embodiment of the invention, the sleeve-shaped free end of the holding pin has retention means, in particular flexible snap-in hooks, to hold the placed-on ring magnet in a shape matched manner at the carrier part and can be radially compressed, in particular due to the flexible snap-in hooks, to enable a placing on of the ring magnet. In this respect, the sleeve-shaped free end of the holding pin can be provided with a radially outwardly projecting collar and can have axially outwardly extending slits to form the flexible snap-in hooks.

The magnetic element or at least a part thereof can furthermore be arranged at the free end of the holding pin, adjoining it, in the axial direction, with the ring magnet being arranged between the carrier base of the carrier part and the magnetic element or the part thereof. It can hereby in particular be ensured that the permanent magnet and the magnetic element are arranged with respect to one another such that the spacing between the permanent magnet and the magnetic element increases on the adjustment of the rotary knob into the pressed position.

The magnetic element can have a shaft that carries a head, in particular a disk-shaped head, with the shaft being plugged into the sleeve-shaped free end of the holding pin and the head being arranged outside the sleeve-shaped free end of the holding pin. The shaft can be plugged into the sleeve-shaped free end of the holding pin with clearance since it is anyway already held at the holding pin due to the magnetic force of the permanent magnet in particular latched to the holding pin.

In accordance with an embodiment of the invention, the rotary knob can have a polygon socket, in particular a hexagon socket, on its side facing the carrier part or at its inner side and the ring magnet is received in it, in particular with an interference fit, in a force-fitted or clamping manner. A secure and simultaneously releasable connection can hereby be established in a simple manner between the rotary knob and the ring magnet. The polygon socket in particular corresponds to the aforesaid receiver in which the ring magnet is received, with the ring magnet being insertable, in particular only, into the polygon socket from the axial direction and/or with the polygon socket being able to be placed, in particular only, onto the ring magnet from the axial position. Generally, however, a force matched connection or a connection with material continuity is also possible.

The present invention further relates to a laboratory device, in particular to a laboratory stirrer, having a housing and having a control element such as has been explained above arranged outside the housing. The control element can be attached to the housing in a shape matched or force-fitted manner or with material continuity. The control element is preferably adhesively bonded to the housing. A sensor arrangement for detecting the rotational position and the axial position of the rotary knob, in particular the rotational position and the axial position of the permanent magnet, is in particular provided that is arranged within the housing.

Figure 2A:
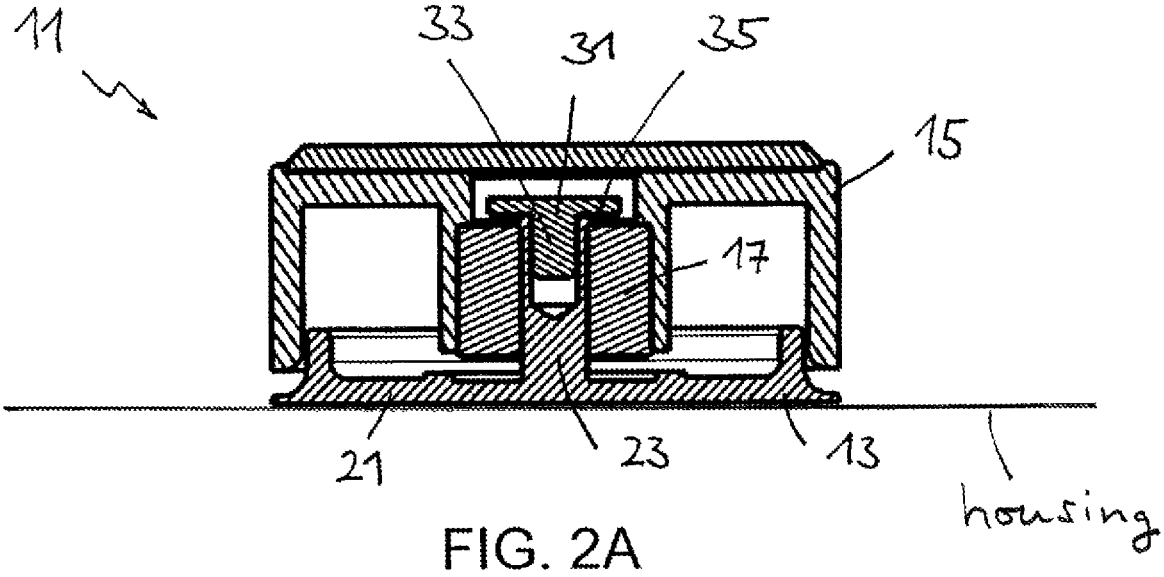
Figure 2B:
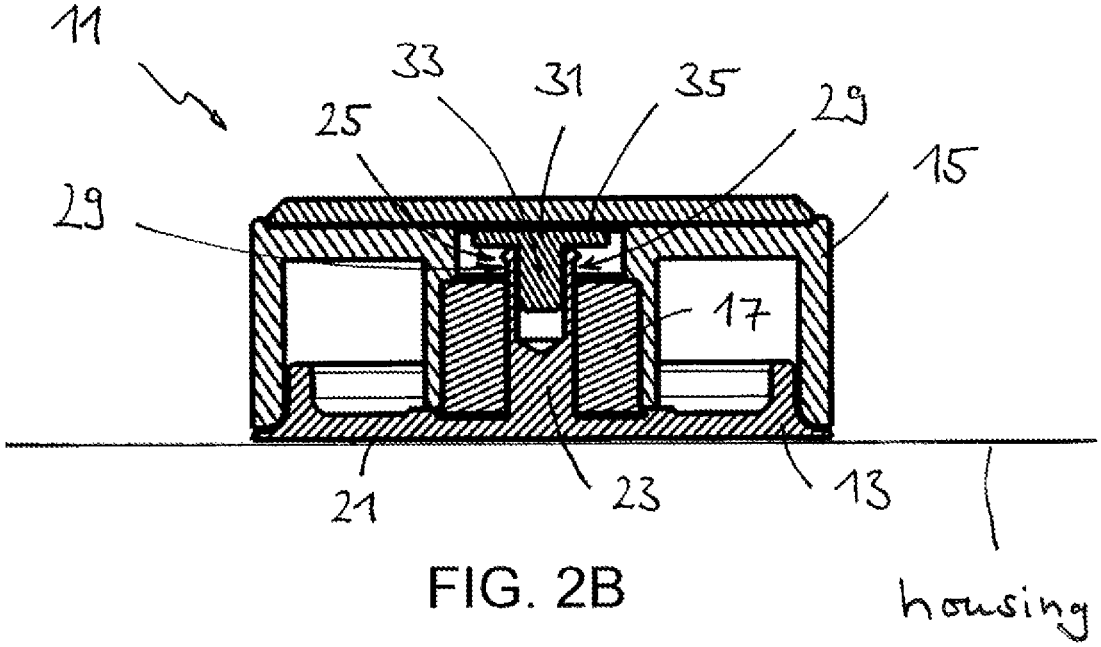
Figure 3:
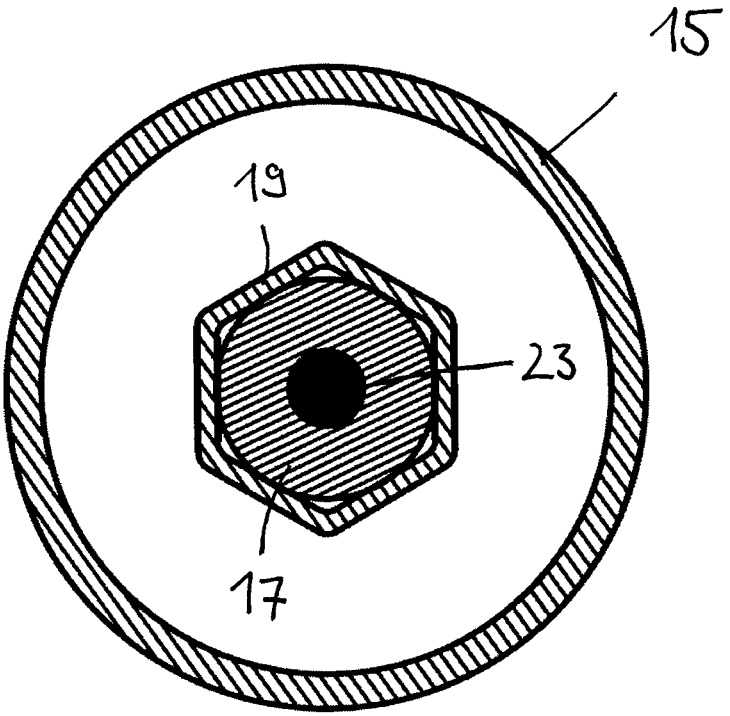

A non-restrictive embodiment of the invention is illustrated in the drawing and will be described in the following. There are shown:

FIG. 1 a control element in accordance with the invention in an exploded view;

FIGS. 2A, 2B the control element of FIG. 1 in a non-pressed position and in a pressed position, each in longitudinal section; and FIG. 3 a rotary knob of the control element of FIG. 1 in a lower view.

FIG. 1 shows a control element 11 for a laboratory device. The control element 11 comprises a carrier part 13 via which the control element 11 is attachable, in particular adhesively bondable, to a housing of a laboratory device and a rotary knob 15 that is held at the carrier part 12, that is manually actuable, and that is rotated about an axis of rotation. A permanent magnet is furthermore provided in the form of a diametrically magnetized ring magnet 17 that is fixedly connected to the rotary knob 15 and whose axial direction coincides with the axis of rotation of the rotary knob 15. The rotational position of the ring magnet 17 that can be recognized by a sensor arrangement arranged within the device housing corresponds to a corresponding rotational position of the rotary knob 15 so that operating parameters of the laboratory device can be set by rotating the rotary knob 15.

The fixed connection between the rotary knob 15 and the ring magnet 17 is achieved in accordance with FIG. 3 in that the rotary knob 15 has a hexagon socket 19 at its inner side facing the carrier part 13 and the ring magnet 17 is received therein with an interference fit and thus in a force-fitted manner. A rotation of the rotary knob 15 therefore has the result of a corresponding rotation of the ring magnet 17.

To hold the rotary knob 15 at the carrier part 13, the carrier part 13 has a holding pin 23 that projects in the axial direction of the rotary knob 15 from a disk-shaped carrier base 21 of the carrier part 13 and onto which the ring magnet 17, that is fixedly connected to the rotary knob 15, is placed in a latching manner. The free end of the holding pin 23 is configured in sleeve shape for this purpose and has a peripheral, radially outwardly projecting collar 25 as well as two axially outwardly extending slits 27. The free end of the holding pin 23 is hereby configured as two respectively radially inwardly bendable flexible snap-in hooks 29 that, on the one hand, permit a placing on of the ring magnet 17 and, on the other hand, latch the placed-on ring magnet and hold it at the carrier part 13 with shape matching.

The rotary knob 15 is furthermore additionally also pressable, i.e. is adjustable in the axial direction relative to the carrier part 13 between a non-pressed position such as is shown in FIG. 2A and a pressed position such as is shown in FIG. 2B. Since the ring magnet 17 is fixedly connected to the rotary knob 15, the ring magnet 17 also adopts a non-pressed or pressed position corresponding to the rotary knob 15. This axial position of the ring magnet 17 can likewise be recognized by the aforesaid sensor arrangement. Once an operating parameter of the laboratory device has been set by rotating the rotary knob 15, the setting of the operating parameter can be confirmed by a subsequent pressing of the rotary knob 15.

To return the rotary knob 15 from its pressed position back into the non-pressed position, an element 31 composed of a magnetic material is provided in the form of a punch. The magnetic element 31 has a shaft 33 and a head 35, with the shaft 33 being plugged into the sleeve-shaped free end of the holding pin 23 and with the head 35 being arranged outside the holding pin 23 adjoining it in the axial direction. The ring magnet 17 is thus arranged between the carrier part 13 and the head 35 of the magnetic element 31 so that the spacing between the ring magnet 17 and the magnetic element 31 increases when the rotary knob 15 is pressed. The diameter of the shaft 33 of the magnetic element 31 is selected such that the free end of the sleeve-shaped holding pin 23 cannot be compressed at least so much that the ring magnet 17 can be pulled off the holding pin 23 when the shaft 33 of the magnetic element 31 is plugged into the holding pin 23.

The magnetic material is a ferromagnetic and soft magnetic material, preferably a ferritic steel, that is magnetized and thereby attracted by the magnetic field of the ring magnet 17. The actuated rotary knob 15 is automatically returned into the unactuated position after the removal of the pressure actuation by the magnetic force that hereby acts between the ring magnet 17 and the magnetic element 31 and thus between the rotary knob 15 and the carrier part 13.

To assemble and attach the above-explained control element 11 to a laboratory device, the carrier part 13 is first adhesively bonded to the housing of the laboratory device, and indeed at the point at which the aforesaid sensor arrangement is located at the inner housing side. The ring magnet 17 is then placed onto the holding pin 23 of the carrier part 13 in a latching manner. The magnetic element 31 is subsequently plugged into the holding pin 23, with the plug-in connection being able to be subject to clearance since the magnetic element 31 is attracted by the ring magnet 17 and is thus already magnetically held at the holding pin 23. Finally, the rotary knob 15 is placed onto the ring magnet 17 from the axial direction. The placing on takes place with force-fit here, with the rotary knob 15 also being able to be pulled off the ring magnet again by a corresponding force.

The control element in accordance with the invention is simple and is made up of few elements and does not require any mechanical spring to return the control button to its starting position after a pressing actuation.

REFERENCE NUMERAL LIST

11 control element
13 carrier part

15 rotary knob
17 ring magnet
19 hexagon socket
21 carrier base
23 holding pin
25 collar
27 slit
29 bending snap-in hook
31 magnetic component
33 shaft
35 head

The invention claimed is:

1. A control element comprising:

a carrier part attachable to a device housing, and a rotary knob, the rotary knob being held at the carrier part, the rotary knob being rotatable about an axis of rotation, the rotary knob being provided with a permanent magnet, the carrier part provided with a holding pin extending through a center of the permanent magnet, and the rotary knob additionally being adjustable in an axial direction relative to the carrier part between a non-pressed position and a pressed position, wherein the rotary knob can be returned from the pressed position into the non-pressed position on the basis of a magnetic force acting between the carrier part and the rotary knob, wherein the permanent magnet is configured as a ring magnet, and the rotary knob comprises a polygon socket, in a view parallel to the axial direction, at a side facing the carrier part in which the ring magnet is received in a force-fitted manner.

2. The control element in accordance with claim 1, wherein the device housing is a housing of a laboratory device.

3. The control element in accordance with claim 1, wherein the rotary knob is fixedly connected to the permanent magnet and the carrier part is provided with an element attracted by the permanent magnet and composed of a magnetic material.

4. The control element in accordance with claim 3, wherein the permanent magnet is insertable into the polygon socket from an axial direction.

5. The control element in accordance with claim 3, wherein the polygon socket is placeable onto the permanent magnet from an axial direction.

6. The control element in accordance with claim 3, wherein the permanent magnet and the magnetic element are arranged with respect to one another such that the spacing between the permanent magnet and the magnetic element increases on the adjustment of the rotary knob into the pressed position.

7. The control element in accordance with claim 3, wherein the magnetic material is a ferritic steel.

8. The control element in accordance with claim 1, wherein the carrier part comprises:

a carrier base attachable to the device housing; and the holding pin projects from the carrier base in the direction of the rotary knob and onto which the ring magnet is placed.

9. The control element in accordance with claim 8, wherein a free end of the holding pin is of sleeve shape.

10. The control element in accordance with claim 9, wherein the sleeve-shaped free end of the holding pin comprises flexible snap-in hooks to hold the placed-on ring magnet in a shape matched manner at the carrier part and can be radially compressed to enable a placing on of the ring magnet.

11. The control element in accordance with claim 10, wherein the sleeve-shaped free end of the holding pin is provided with a radially outwardly projecting collar and comprises axially outwardly extending slits to form the flexible snap-in hooks.

12. The control element in accordance with claim 8, wherein a magnetic element or at least a part thereof is arranged at a free end of the holding pin, adjoining the holding pin, in the axial direction, with the ring magnet being arranged between the carrier base of the carrier part and the magnetic element or the part thereof.

13. The control element in accordance with claim 8, wherein a magnetic element comprises a shaft that carries a head, with the shaft being plugged into a sleeve-shaped free end of the holding pin, and with the head being arranged outside the sleeve-shaped free end of the holding pin.

14. A device comprising a housing and a control element arranged outside the housing, the control element comprising:

a carrier part attachable to the housing of the device the carrier part including a holding pin extending therefrom; and a rotary knob, the rotary knob being held at the carrier part, the rotary knob being rotatable about an axis of rotation, the rotary knob being provided with a permanent magnet, the holding pin extending through a center of the permanent magnet, and the rotary knob additionally being adjustable in an axial direction relative to the carrier part between a non-pressed position and a pressed position, wherein the rotary knob can be returned from the pressed position into the non-pressed position on the basis of a magnetic force acting between the carrier part and the rotary knob, wherein the permanent magnet is configured as a ring magnet, and the rotary knob comprises a polygon socket, in a view parallel to the axial direction, at a side facing the carrier part in which the ring magnet is received in a force-fitted manner.

15. The device in accordance with claim 14, wherein the control element is attached to the housing in a shape matched or force-fitted manner or with material continuity.

* * * * *